US005300002A

United States Patent [19]

Freye

[11] Patent Number: 5,300,002

[45] Date of Patent: Apr. 5, 1994

[54] UPPER AND LOWER BODY FRICTIONAL RESISTANT-TYPE EXERCISING DEVICE

[76] Inventor: Allen E. Freye, 1013 Butternut Ct., SE, Olympia, Wash. 98503

[21] Appl. No.: 900,833

[22] Filed: Jun. 18, 1992

[51] Int. Cl.[5] ..... A63B 21/30; A63B 5/00

[52] U.S. Cl. ..... 482/114; 482/45

[58] Field of Search ..... 482/114, 115, 118, 44, 482/45, 49, 46, 33, 46; 273/DIG. 30

[56] References Cited

U.S. PATENT DOCUMENTS

| | | | |
|---|---|---|---|
| 1,023,756 | 2/1911 | Pons . | |
| 1,552,073 | 4/1925 | Mansfeldt | 272/84 |
| 1,714,391 | 5/1929 | McWhirter | 272/84 |
| 2,106,994 | 4/1937 | Chapman | 272/57 |
| 2,132,862 | 2/1937 | Pilates | 272/57 |
| 2,470,816 | 5/1949 | Harvey | 272/84 |
| 2,668,055 | 2/1954 | Sharp et al. | 272/68 |
| 3,069,804 | 12/1962 | Cirafesi | 46/1 |
| 3,084,547 | 4/1963 | Nielsen | 73/379 |
| 3,184,234 | 5/1965 | Struble | 482/114 |
| 3,211,453 | 10/1965 | Williams | 272/68 |
| 3,268,225 | 8/1966 | Kolbel | 272/83 |
| 3,330,558 | 7/1967 | Simons, Jr. | 272/68 |
| 3,396,967 | 8/1968 | Brown | 272/67 |
| 3,510,130 | 5/1970 | Ferdinand | 272/67 |
| 3,637,205 | 1/1972 | Bankston | 482/114 |
| 3,649,008 | 3/1972 | Zinken et al. | 272/67 |
| 3,708,164 | 1/1973 | Griffin | 272/67 |
| 3,717,338 | 2/1973 | Hughes | 272/67 |
| 3,759,514 | 9/1973 | Cox | 272/83 |
| 3,764,131 | 10/1973 | Rooks | 272/67 |
| 3,830,493 | 8/1974 | Miller | 272/67 |
| 3,944,221 | 3/1976 | Berkestad et al. | 272/79 |
| 4,095,789 | 6/1978 | Mueller | 272/140 |
| 4,165,070 | 8/1979 | Rice | 272/68 |
| 4,171,802 | 10/1979 | Stoecker | 272/67 |
| 4,193,593 | 3/1980 | Wilson | 272/137 |
| 4,203,591 | 5/1980 | Gibson | 272/67 |
| 4,466,610 | 8/1984 | Israel | 272/93 |
| 4,588,191 | 5/1986 | Stewart | 273/DIG. 30 |
| 4,591,151 | 5/1986 | Hensley | 272/140 |
| 4,643,417 | 2/1987 | Nieman | 272/67 |
| 4,664,373 | 5/1987 | Hait | 272/117 |
| 4,695,049 | 9/1987 | Ciemiega | 272/67 |
| 4,838,542 | 6/1989 | Wilkinson | 272/67 |
| 4,869,492 | 9/1989 | Joutras | 482/118 |

*Primary Examiner*—Stephen R. Crow

*Attorney, Agent, or Firm*—Christensen, O'Connor, Johnson & Kindness

[57] ABSTRACT

A lightweight exercise device comprising a pole of nearly uniform diameter throughout its length. At each end of the pole are knob handles to be manually gripped by the operator. One knob handle is fixed and the opposite end knob handle is rotatable continuously in either direction. The rotating handle can engage a friction assembly within the handle to resist motion while pulling or pushing on the handle. Between the handles and along the pole can be one or two sliding or twisting friction sleeve handles or no sleeve handles depending on the length of the pole and configuration of the exercise device desired by the operator. The sliding or twisting friction sleeve handle resistance can be changed by the operator gripping the sleeve handle with increasing or decreasing pressure by the operator's hands. This exerciser is adapted to assist the user to perform stretching, isometric, isotonic, and isokinetic exercises and to combine them with various aerobic exercises. The operator can exercise various muscles of the body by performing an extremely wide variety of manipulations of the exercise device.

19 Claims, 3 Drawing Sheets

UPPER AND LOWER BODY FRICTIONAL RESISTANT-TYPE EXERCISING DEVICE

FIELD OF THE INVENTION

The present invention relates to an exercising device and more particularly to a portable exercising device employing a fixed end handle, an end handle that can be rotated with resistance, and sleeve handles that can slide and rotate with resistance. The present invention is used in developing and toning various body muscles by persons of widely varying physical abilities while the user is standing, sitting, lying prone, walking or jogging, or while performing various other aerobic activities. The present invention can be used to simulate dumbbell or barbell weights without the weights associated with them. Also, the present invention can be used to simulate exercise devices employing springs or rubber bands without the danger of buildup and release of tension associated with these types of devices.

BACKGROUND OF THE INVENTION

Many portable exercising devices have been developed in the past. By design and operation, however, these prior devices were limited in their functional capabilities to certain types of exercises of the body. None of these exercisers are capable of the full range of exercises available to the operators of this invention.

Furthermore, most of the prior exercise devices that employed mechanical systems were complicated devices, expensive to manufacture, unreliable in their use, and susceptible to malfunctions. The present invention is specifically adapted to eliminate the need for heavy weights, complicated mechanical systems to simulate weights, and systems employing rubber band and spring tensions to simulate weights. The exerciser of the present invention takes advantage of certain mechanical and physical resistance properties to allow the user to perform a complete regimen of upper body and certain lower body exercises to develop most of the major muscle groups of the body. Therefore, the exerciser of the present invention overcomes some limitations in each of the other prior art exercisers in its class.

SUMMARY OF THE INVENTION

One embodiment of the present invention includes a straight rigid pole or bar member having at each end a knob handle with one knob handle fixed to the straight rigid pole. The other knob handle employs an internal resistive assembly that is fixed to the straight rigid pole while allowing rotation of the knob handle in either direction continuously or alternately at the discretion of the operator. This resistive assembly provides increasing resistance as the operator pulls or pushes with greater force on the knob handle while rotating said knob handle. The pole member has one or two sliding or twisting friction sleeve handles that closely encompass the pole member. The tightness with which the sleeve handle is gripped determines the frictional resistance to movement of each sleeve handle.

In another embodiment, the range of motion of the exercise can be increased by removal of one sleeve handle. As one sleeve handle employs a hook and latch closing device of the type sold under the name Velcro TM, it becomes a removable sleeve handle at the discretion of the operator to increase the linear movement range of the nonremovable sliding friction sleeve handle. In still another embodiment, because of the short length of the rigid pole member on certain models of the invention, no sleeve handle or only one sleeve handle may be employed. In another embodiment, each of the exercisers having a pole length of 9 inches or greater may employ a slight diameter variation increasing uniformly along the length of the pole or bar which will uniformly increase the sliding friction resistance from one end to the other.

A feature of the present invention is the independent operation of each of the various handles with the pole member or with any other of the handles of the exerciser.

Another feature of the invention is the internal resistive device in one knob handle that allows for a variety of finger, hand, wrist, arm, and shoulder exercises by the operator.

Another feature of the present invention is the employment of sliding and twisting friction sleeve handles which resist the movements of the operator as the user applies selective gripping resistance with one or both hands as the operator chooses.

Another feature of the invention is the slight uniform variation in diameter of the pole or bar from one end to the other, in models with pole members of 9 inches or over, which will uniformly increase or decrease the resistance to the movement of the sliding handles along the length of the pole.

Another feature of the invention is the Velcro TM closure on one sleeve handle that allows easy removal of the sleeve handle for increased range of motion by the nonremovable sleeve handle.

Another feature of the invention is a coating of the pole member, when used in conjunction with the particular friction sleeve material, has useful properties that allow for uniform operation of the various friction elements when used by the operator.

Another feature of the present invention is the various model lengths, from 4 to 60 inches, which allow the user to select a model depending on the characteristics and uses intended by the operator.

It is an objective of this invention to provide a simple to operate general exercising device for the development of the muscles throughout the body of the operator, no matter whether the operator be young or old, male or female, beginning exerciser or bodybuilder, and even for those undergoing medical rehabilitation.

It is a further objective of this invention to provide an exercising device which is lightweight and portable.

It is a still further objective of this device to provide an exercising device which is extremely multifunctional yet which is simple, practical, cheap, efficient, and safe to use.

Another objective of this device is to provide an exercising device which is resistive to wear, is sturdy and durable in construction, and will provide an extremely long and useful life cycle.

In general, it is an object of the present invention to provide an exerciser which will overcome the limitations and disadvantages of prior art exercisers and provide for an exercise routine that can be accomplished while the user is in any body position, such as sitting, standing, inclined, lying, bent over, kneeling, walking, or jogging, or while performing an aerobic routine.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
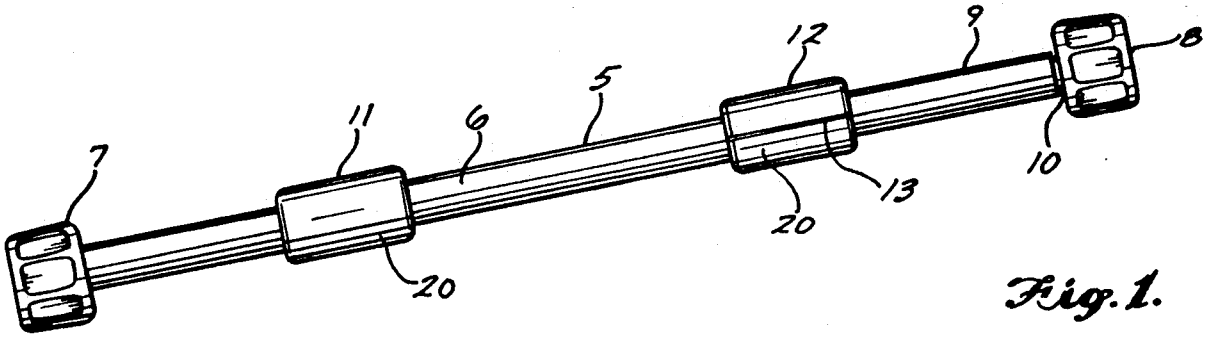
FIG. 1 is a side elevational view of an exercising device constructed in accordance with the present invention.
Figure 2:
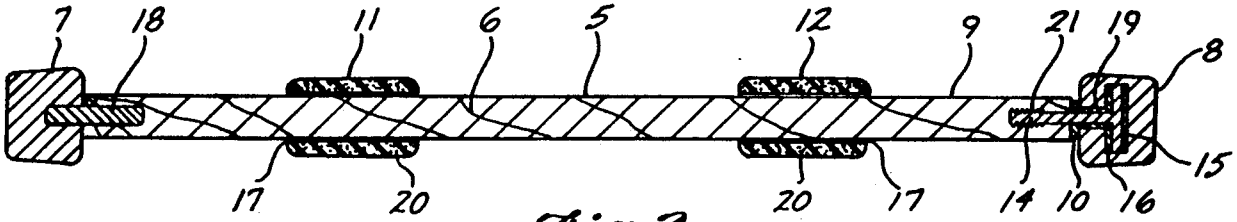
FIG. 2 is a cross-sectional view taken longitudinally along the length of the exercising device of FIG. 1.
Figure 3:
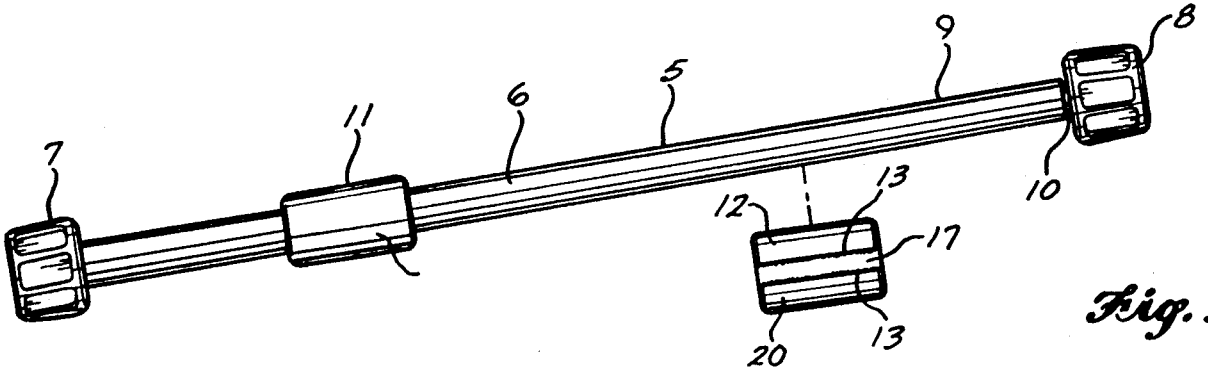
FIG. 3 is a side elevational view of another embodiment of the present invention.

Illustrated in FIGS. 1, 2, and 3 is a device 5 for performing exercises and exercise routines in virtually any position of the body, such as standing, sitting, inclined, bent over, or lying prone, and even while walking and jogging.

The device 5 includes a straight rigid, solid or hollow, cylindrical rod, shaft, bar or pole member 6 of uniform diameter or uniformly varying diameter from one end to the other. The bar member should be of a diameter which can be grasped in a user's hand with the fingers encircling a major segment thereof. In the preferred embodiment, the diameter is approximately 1 to 1⅛ inch with a preferable size of approximately 1-1/16 inch. The bar member 6 can be any length from 1½ inch to approximately 60 inches with the preferable length being approximately 24 inches. In one embodiment, the bar member 6 has a bar length from 1½ to 9 inches and is of uniform diameter throughout the length. In alternate embodiments, the bar member 6 has a length from 9 inches to 60 inches and the diameter could increase uniformly along the length of the bar member. In one embodiment, the uniform increase in diameter is of approximately 1/32 to 1/16 inch from one end of the bar member to the other. This slight increase in diameter adds to the resistive effect of the sliding resistive sleeve members 11 and 12 in embodiments which employ this feature. In the preferred embodiment, the bar member 6 and end handles 7 and 8 are of wood with a coating 9 of polyurethane of a type that can also be applied to plastic or metal parts. The coating 9 provides a smooth uniform surface which is free from burrs and protuberances which may injure a person or deter sliding movements along the length of the bar member 6.

The diameter of the bar member 6 should be sufficiently large that it provides safety from breakage in longer models and also provides appreciable resistance to sliding or twisting movement of the resistive sleeve handles 11 and 12. Also the bar member 6 should be sufficiently large that a person can securely grip the bar with enough force to perform isometric exercises, but not so large that the resistive sleeve members 11 and 12, when fitted on the bar, are of a diameter that can be comfortably and securely gripped by the user when performing the various exercises.

The exerciser 5 should be of a weight, even in the longer models, which can be usefully employed by operators who are undergoing physical rehabilitation or by young persons of either sex who choose to perform the range of exercises available to the users of this invention. This weight should be less than five pounds in all models.

The sliding resistive sleeve handles 11 and 12 are formed from a closed or open cell rubber compound 20 that is compressible when squeezed so that, when coupled with a leather, heavyweight suede, or other suitable sleeve insert 17, the pressure applied by the hands will increase the resistive sliding or twisting action upon the bar member 6 and polyurethane coating 9. The inside diameter of the sleeve insert 17 is only fractionally larger than the outside diameter of the bar member 6 when the sliding sleeve handles 11 and 12 are fitted onto the bar member 6. This close fitting of the sliding sleeve handles 11 and 12 on the bar member 6 allows the user to apply a great range of friction pressures along the bar member 6 with a slight to moderate grip pressure from the hands.

One or both of the sliding sleeve handles can be of the type 12, which employs a releasable fastener 13 or closure mechanism (FIG. 10) such as a hook and latch fastener sold under the trademark Velcro TM, thus allowing removal of the handle at the option of the user when performing various types of exercises or exercise routines.

Figure 9:
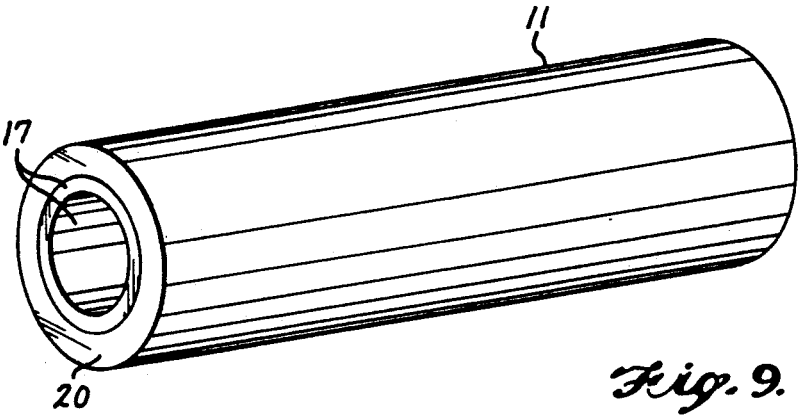
FIG. 9 is a perspective view of the nonremovable resistive sliding sleeve handle.
Figure 10:
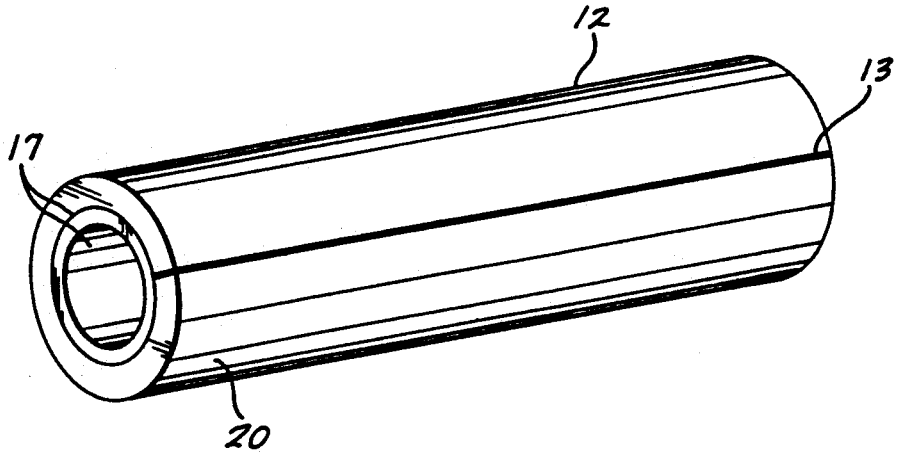
FIG. 10 is a perspective view of the removable resistive sliding sleeve handle showing the hook and latch closure along the length of the handle.

The sliding resistive sleeve handles 11 and 12 in FIGS. 9 and 10, respectively, should be of a width that is wider than a person's hand, in the preferred embodiment approximately 4½ inches wide, so that the hands will not extend beyond the width of the handles and cause friction burns to the hands when performing the various exercises.

The sliding resistive sleeve handles 11 and 12, when fitted on the bar member 6, should be of a diameter which allows the user's hands to enclose more than ½ the circumference of the handles. In the preferred embodiment, the diameter is approximately 1⅜ to 1¾ inches on all of the models of exercisers that employ sliding resistive sleeve handles 11, 12, or both. Such a diameter allows the sleeve handles 11 and 12 to come in contact with each other and provide an additional resistance to twisting motions by the user while they are in contact and not allow the user's hands to rub together.

In alternate embodiments, the rough side of the leather or heavyweight suede insert 17 comes in contact with the outer surface or coating 9 of the bar member 6 in order to provide an even greater resistance than a smooth leather surface would present to the operation of the resistive sleeve members 11 and 12. This is an option to the user when selecting the model of exerciser and types of resistive sleeve members 11 and 12 with sleeve insert 17.

The fixed and rotatable knurled knob end handles 7 and 8 respectively should be of such a size as to allow the user to securely grasp the handles while performing the various exercises employing the end handles 7 and 8 portion of the exerciser. In the preferred embodiment, the diameter of the end knob handles ranges from approximately 2 inches to approximately 2¼ inches, with the optimum size being approximately 2⅛ inches, depending on the model selected by the user. In any case, each of these different sizes can be successfully employed in the various exercises by the full range of anticipated users with little or no loss in gripping efficiency.

Figure 4:
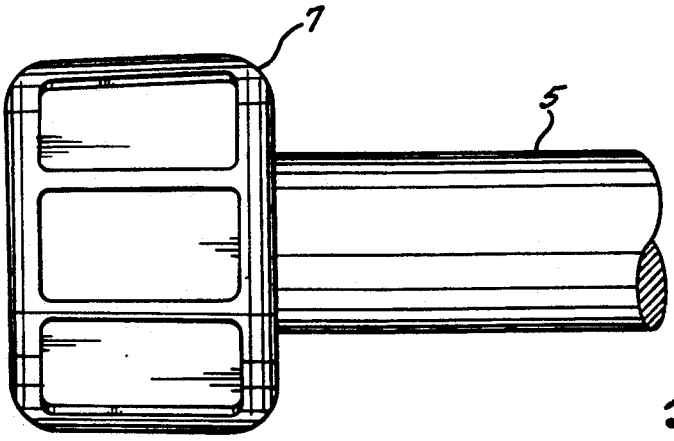
FIG. 4 is a side view of the fixed end knob handle.
Figure 5:
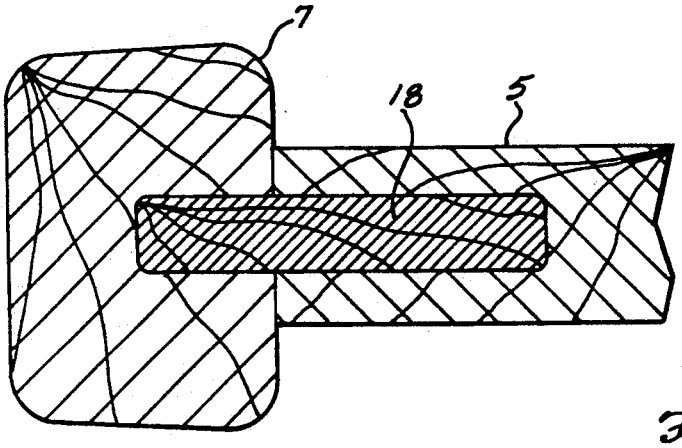
FIG. 5 is a cross-sectional view of the fixed end knob handle.

In the preferred embodiment, the end knob handles 7 and 8 are knurled (see FIG. 4) to allow manipulation of the end knob handles with the fingers of the user for a greater range of exercises available to the user of this invention.

In the preferred embodiment, the fixed end knob handle 7 (see FIG. 4) is fixed in place on the wooden models by gluing in place at the junction of the fixed end knob handle and the bar member 6 and employing a ½×2 inch hardwood dowel peg 18 embedded in the end knob 7 and bar member 6 for security. However, other methods of attachment could also be used.

The fixed end knob handle 7 is best employed on the end of bar member 6, which has the greater diameter in models which employ this uniformly varying diameter along the length and having a bar member length of 9 inches or greater.

The end knob handle 7 is fixed to add to the range of difficulty and types of exercises that can be performed by the user. When the fixed end knob handle 7 is employed with a sliding sleeve handle 11 or 12, a range of different exercises with the full range of difficulty is available to the user.

In the preferred embodiment, the rotatable end knob handle 8 (see FIG. 6) is fixed in place by a flathead metal bolt 14 of approximately 2½ inches in length and ¼ inch in diameter, with a head size of approximately 1½ inches in diameter, flat on both the top and bottom in order to receive a leather or other suitable friction material 15 and 16. A leather, or other suitable material, spacer 10 is employed to allow the compression action by the user when the rotatable end knob handle 8 is being pushed and twisted by the user. This pushing and twisting action puts compression friction on both friction materials 10 and 15 because the flathead bolt 14 is fixed in place within the bar member 6 with epoxy on the threaded section 21 of the flathead bolt 14.

A pulling action by the user on the rotatable end knob handle 8 applies compression friction on the friction material 16 by the flathead bolt 14 because the flathead bolt is fixed in place.

This pulling and pushing twisting action on the rotatable end knob handle 8 by the user, when used in combination with either sliding sleeve handles 11 or 12, opposite end handle 7, or bar member 6, allows the user a great number and range of resistive exercises.

Figure 6:
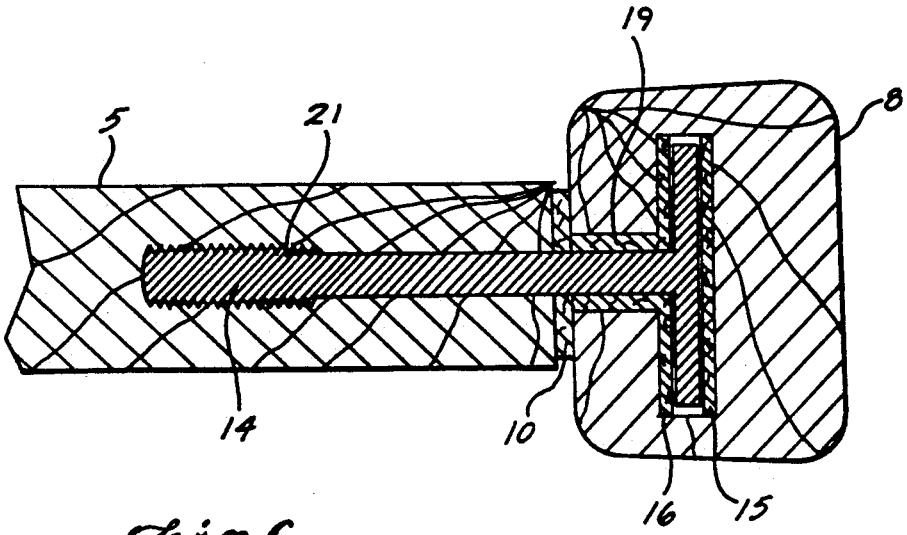
FIG. 6 is a cross-sectional view of the rotatable resistive end knob handle.
Figure 7:
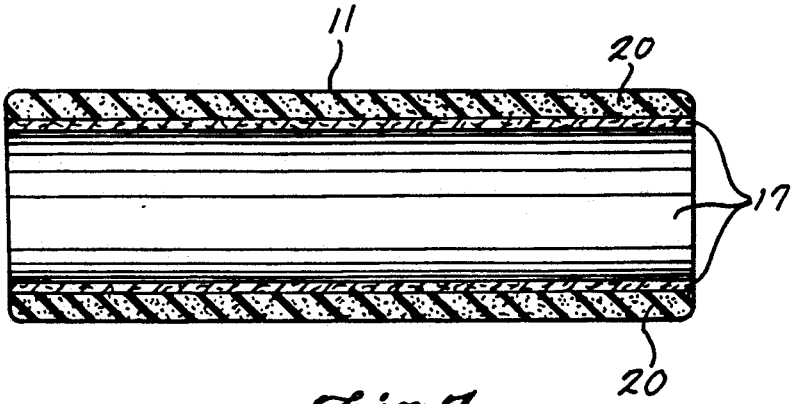
FIG. 7 is a cross-sectional view of the nonremovable resistive sliding sleeve handle.
Figure 8:
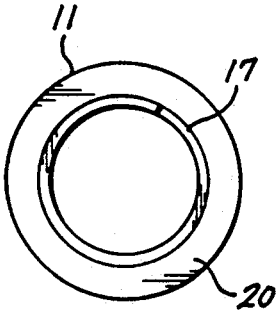
FIG. 8 is an end view of the nonremovable resistive sliding sleeve handle.

In order to prevent excessive wear and noise from the metal bolt 14 on the wood adjacent to the metal in the rotatable end knob handle 8 in FIG. 6, it may be advantageous to press fit a nonlubricated sleeve bearing 19 of suitable size, for example, ½ inch long by ¼ inch inside diameter, in the end knob handle 8, so that the sleeve receives the metal bolt 14.

The end knob handles 7 and 8 form stops for the sliding sleeve handles 11, 12, or both. When the sliding sleeve handles 11 or 12 come in contact with the end knob handles 7 or 8 during an exercise routine, the knob handles' inside surfaces provide additional resistive surfaces for increasing the range of difficulty in performance of the exercise.

A multitude of exercises and exercise routines can be performed with the present invention in all of the various models and sizes by employing various combinations of end knob handles 7, 8, or both and with bar or pole member 6. These exercises and exercise routines can employ any one or a combination of isometric, isotonic, or isokinetic exercises for developing or toning most of the muscle groups throughout the body, including the legs, but mainly for the upper body and shoulders, arms, wrists, hands, and fingers of the user. These exercises can be performed by the user while the body is in most any configuration, such as standing, inclined, sitting, bent over, kneeling, lying prone, walking, or jogging. The exercises available to the user of the present invention allow the user to use gripping, pulling, twisting, sliding, or pushing actions with a full range of resistances at the immediate choice of the user while in the process of performing the exercises. Just by the user applying a greater or lesser grip force during the performance of the exercise, the user can increase or decrease the resistance to movement throughout the exercise movement from beginning to end.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An exercising device comprising:

(a) a straight pole;

(b) a knob rigidly attached to a first end of the pole; and (c) a rotatable knob attached to a second end of the pole, the rotatable knob including first resistance means for providing an increasing force so as to oppose rotation of the rotatable knob as the rotatable knob is twisted and pulled in a direction away from the second end of the pole or twisted and pushed in a direction toward the second end of the pole with an increasing force.

2. The exercise device of claim 1, further comprising a rotatable and slidable handle mounted on the pole.

3. The exercise device of claim 2, wherein the handle includes a second resistance means for providing an increasing force so as to oppose both rotational and sliding movement of the handle as the handle is compressed inwardly toward the pole with an increasing force.

4. The exercise device in claim 3, wherein the second resistance means comprises a frictional material interdisposed between the handle and the pole.

5. The exercise device of claim 4, wherein the frictional material is a leather material.

6. The exercise device of claim 2, wherein the handle includes release means for releasably attaching the handle to the pole.

7. The exercise device of claim 6, wherein the release means comprises a hook and latch-type fastener extending longitudinally across the width of the handle.

8. The exercise device of claim 2, wherein the handle is formed of a resilient, flexible foam material.

9. The exercise device of claim 1, wherein the diameter of the pole increases uniformly along the length of the pole.

10. The exercise device of claim 1, wherein the first resistance means comprises means for providing an increasing frictional force as the rotatable knob is twisted and pulled in a direction away from the second end of the pole or twisted and pushed in a direction toward the second end of the pole with an increasing force.

11. The exercising device of claim 3, wherein the second resistance means comprises a disc rigidly attached to the second end of the pole and a frictional insert coupled to the disc so as to contact the rotatable knob and the disc when the rotatable knob is twisted and pulled in a direction away from the second end of the pole or twisted and pushed in a direction toward the second end of the pole.

12. The exercise device of claim 1, wherein the pole and knobs are formed of wood.

13. An exercise device comprising:

(a) a pole;

(b) two rotatable and slidable handles mounted on the pole, each handle including first resistance means for providing an increasing force so as to oppose both rotational and sliding movement of said handles as said handle is compressed inwardly toward the pole with an increasing force, one of said handles including release means for releasably attaching said handle to the pole;

(c) a knob rigidly attached to a first end of the pole; and (d) a rotatable knob attached to a second end of the pole, the rotatable knob including second resistance means for providing an increasing force so as to oppose rotational movement of the rotatable knob as the rotatable knob is twisted and pulled in a direction away from the second end of the pole or twisted and pushed in a direction toward the second end of the pole with an increasing force.

14. The exercise device of claim 13, wherein the slidable handles are cylindrical and wherein the first resistance means comprises a cylindrical leather insert interdisposed between the handle and the pole.

15. The exercise device of claim 14, wherein the cylindrical handle is formed of a resilient, flexible foam material.

16. The exercise device of claim 13, wherein the diameter of the pole increases uniformly along the length of the pole.

17. The exercise device of claim 13, wherein the pole and knobs are formed of wood.

18. The exercise device of claim 13, wherein the release means comprises a hook and latch-type fastener extending longitudinally across a width of the handle.

19. The exercising device of claim 13, wherein the second resistance means comprises a disc rigidly attached to the second end of the pole and a frictional insert coupled to the disc so as to contact the rotatable knob and the disc when the rotatable knob is twisted and pulled in a direction away from the second end of the pole or twisted and pushed in a direction toward the second end of the pole.

* * * * *

UNITED STATES PATENT AND TRADEMARK OFFICE

CERTIFICATE OF CORRECTION

PATENT NO. : 5,300,002
DATED : April 5, 1994
INVENTOR(S) : A. E. Freye

It is certified that error appears in the above-indentified patent and that said Letters Patent is hereby corrected as shown below:

On the title page:

[56] 9th Ref. "3,084,547 4/1963 Nielsen" should read
"U.S. Patents" --3,084,547 9/1961 Nielsen--

[56] 11th Ref. "3,211,453 10/1965 Williams" should read
"U.S. Patents" --3,211,453 11/1962 Williams--

[56] 25th Ref. "4,165,070 8/1979 Rice" should read
"U.S. Patents" --4,165,070 12/1977 Rice--

Signed and Sealed this
Second Day of August, 1994

*Attest:*

*Attesting Officer*

BRUCE LEHMAN

*Commissioner of Patents and Trademarks*